US005226348A

United States Patent [19]

Dezelan et al.

[11] Patent Number: 5,226,348

[45] Date of Patent: Jul. 13, 1993

[54] ELECTRO-HYDRAULIC QUICK DROP CIRCUIT

[75] Inventors: Joseph E. Dezelan, Joliet; Stephen J. Tlachac, Naperville, both of Ill.

[73] Assignee: Caterpillar Inc., Peoria, Ill.

[21] Appl. No.: 990,317

[22] Filed: Dec. 14, 1992

[51] Int. Cl.[5] ..... F15B 11/08

[52] U.S. Cl. ..... 91/436; 91/446; 91/448; 91/461

[58] Field of Search ..... 91/415, 436, 444, 445, 91/446, 447, 448, 442, 420, 421, 459, 461; 60/459, 468

[56] References Cited

U.S. PATENT DOCUMENTS

| | | | |
|---|---|---|---|
| 3,438,307 | 4/1969 | Ahlenius | 91/436 |
| 3,568,707 | 3/1971 | Shore | 91/436 X |
| 3,965,587 | 6/1976 | Johns, Jr. | 91/436 X |
| 4,397,221 | 8/1983 | Friesen et al. | 91/436 X |
| 4,694,647 | 9/1987 | Yoshida | 91/461 X |
| 4,770,083 | 9/1988 | Johnson | 91/461 X |
| 4,955,282 | 9/1990 | Ranson | 91/436 |
| 5,014,734 | 5/1991 | Smith | 137/117 |
| 5,081,904 | 1/1992 | Horn et al. | 91/420 |

*Primary Examiner*—Edward K. Look
*Assistant Examiner*—Hoang Nguyen
*Attorney, Agent, or Firm*—John W. Grant

[57] ABSTRACT

Quick drop valves are useful in directing fluid expelled from a contracting chamber of a hydraulic actuator to its expanding chamber under gravity load conditions. The present electro-hydraulic quick drop circuit improves the efficiency of the quick drop valve by energizing a solenoid valve to direct load generated pressure from the rod end chamber of the hydraulic actuators to an end of a quick drop valve for moving the quick drop valve to the quick drop position when a control valve is at or between a preselected intermediate operating position and its fully open position. The quick drop valve is moved to the quick drop position immediately upon the control valve reaching the preselected operating position so that the fluid expelled from the rod end chamber is directed to the head end chamber almost immediately after the blade begins to freefall. Also the quick drop valve totally blocks the rod end chambers from the control valve so that all the fluid expelled from the rod end chambers is directed to the head end chambers at the quick drop position of the quick drop valve.

5 Claims, 1 Drawing Sheet

ELECTRO-HYDRAULIC QUICK DROP CIRCUIT

TECHNICAL FIELD

This invention relates generally to a hydraulic system for controlling the elevational position of a bulldozer blade, or the like, and more particularly to an electro-hydraulic quick drop circuit for improving the efficiency of the system.

BACKGROUND ART

Quick drop valves are commonly used in hydraulic control systems for bulldozer blades, or the like, in which the blade is allowed to freefall to ground level under the force of gravity. Some of the fluid expelled from the double acting hydraulic actuators which control blade elevation is diverted by the quick drop valves to the expanding ends of actuators to supplement the pump flow thereto. Without any type of quick drop valve, the expanding ends of the actuators cavitate quite badly. Since the cavitated ends of the actuators have to be filled with fluid from the pump after the blade comes to rest on the ground, a considerable time lag occurs before sufficient downward force can be applied to the blade for penetrating the ground. The use of quick drop valves minimizes the cavitation and, thus, reduces the time lag.

The known quick drop valves are moved to and retained in the quick drop position by differential pressure generated by the expelled fluid passing through a triggering orifice once the flow rate of the expelled fluid exceeds a predetermined rate. The size of the orifice usually dictates how quickly sufficient differential pressure is generated to move the valve to the quick drop position and how much of the expelled fluid can be diverted to the expanding ends of the actuators. One of the problems encountered with the use of the triggering orifice is that at least some of the expelled fluid must pass through the trigging orifice in order to maintain a pressure differential sufficient to hold the quick drop valve in the quick drop position. The fluid passing through the orifice is directed back to the tank and, thus, cannot be used to help fill the expanding end of the actuator such that efficiency of the quick drop valve is compromised.

Another problem encountered with the known quick drop valves is that in one mode of operation the blade is allowed to freefall from the raised position and then suddenly stopped before the blade reaches the ground in order to shake loose any material adhering to the blade. With the known quick drop valves, however, the main control valves must be moved essentially back to the neutral position before the quick drop valve can move back to its non-quick drop position.

Thus, it would be desirable to have a quick drop valve circuit constructed so that all of the fluid expelled from the actuators is diverted back to the expanding ends of the actuators. It would also be desirable to have a quick drop valve circuit in which the quick drop valve can be quickly returned to its non-quick drop position before the main control valve reaches the neutral position.

The present invention is directed to overcoming one or more of the problems as set forth above.

DISCLOSURE OF THE INVENTION

In one aspect of the present invention, an electro-hydraulic quick drop circuit is provided for a hydraulic system having a hydraulic pump, a tank, a hydraulic actuator having first and second actuating chambers, and a control valve connected to the pump and the tank and having first and second ports connected to the first and second actuating chambers respectively with the control valve being movable from a neutral position through an intermediate operating position to a fully open position. The circuit includes a two-position quick drop valve disposed between the control valve and the first and second actuating chambers, respectively. The quick drop valve has a first position communicating the first and second ports with the first and second actuating chambers, respectively, and a second position communicating both the first port and the second chamber with the first chamber and blocking the second chamber from the second port. The quick drop valve has first and second ends and a spring resiliently biasing the quick drop valve to the first position. A two-position solenoid valve is connected to the second chamber and to the ends of the quick drop valve and has a first position communicating the second actuating chamber to the first end of the quick drop valve aiding the force of the spring and a second position communicating the second actuating chamber to the second end opposing the force of the spring. A means is provided for energizing the solenoid valve and moving it to the second position when the control valve is positioned between the intermediate and fully open operating positions.

BRIEF DESCRIPTION OF THE DRAWINGS

The sole figure is a diagrammatic schematic illustration of an embodiment of the present invention.

BEST MODE FOR CARRYING OUT THE INVENTION

Figure 1:
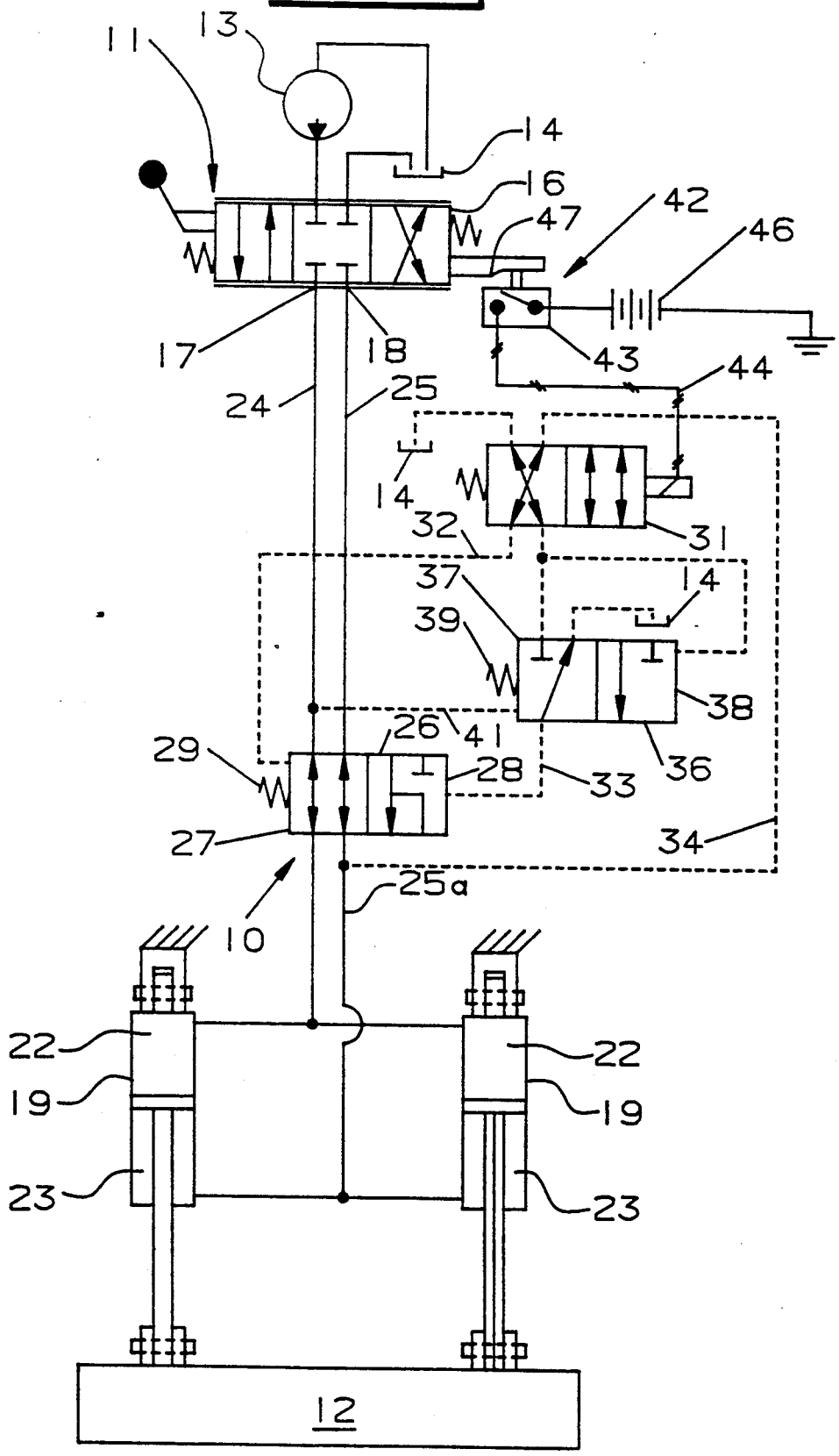

An electro-hydraulic quick drop circuit 10 is shown incorporated within a hydraulic system 11 for controlling the elevational position of a load which in this embodiment is represented by a bulldozer blade 12. The hydraulic system 11 includes a hydraulic pump 13, a tank 14, a directional control valve 16 connected to the hydraulic pump and the tank 14 and having a pair of inlet-outlet ports 17,18, a pair of double acting hydraulic actuators 19 with each actuator having a head end actuating chamber 22 and a rod end actuating chamber 23, and a pair of conduits 24,25 connecting the port 17 with the head end chamber 22 and the port 18 with the rod end chamber 23. The actuators 19 are suitably connected to a work vehicle, not shown, and to the blade 12. The blade is acted on by gravity such that the weight thereof establishes a generally downwardly dropping direction tending to extend the actuators. The control valve 16 is moveable in either direction from the neutral blocking position shown to fully open positions and passes through a preselected operating position as hereinafter described.

The quick drop circuit 10 includes a quick drop valve 26 disposed within the conduits 24,25 between the control valve 16 and the actuators 19. The quick drop valve 26 has a spring end 27, a shift end 28 and a spring 29 at the spring end 27 to resiliently bias the quick drop valve to the position shown. A two-position solenoid valve 31 is connected to the spring end 27 through a pilot passage 32 and to the shift end 28 through a pilot passage 33. A pilot passage 34 connects the solenoid valve to a portion **25*a* of the conduit 25 between the quick drop valve 26 and the rod end chambers 23. A dump valve 36** is disposed within the pilot passage 33 and has opposite ends 37,38 and a spring 39 disposed at the end 37 resiliently urging to the position shown. The end 37 is connected to the conduit 24 through a pilot passage 41 while the end 38 is connected to the pilot passage 33 between the dump valve 36 and the solenoid valve 31. Alternatively, the end 38 can be connected directly to the pilot passage 34.

A means 42 is provided for energizing the solenoid valve 31 and moving it leftwardly to a second position when the control valve 11 is positioned between the intermediate and fully open positions. The means 42 includes a normally open electrical switch 43 connected to the solenoid valve through a lead line 44 and to a source of electrical energy 46. The switch is positioned at a location sufficient to be moved to the closed position by a cam 47 suitably connected to the control valve 16 when the control valve is between the intermediate and fully open positions.

INDUSTRIAL APPLICABILITY

The quick drop valve 26, the dump valve 36 and the solenoid valve 31 are normally biased to their first positions as shown when the control valve 16 is in its neutral fluid blocking position. With the quick drop valve 26 in its first or non-quick drop position, the port 17 communicates with the head end chambers 22 through the conduit 24 and the port 18 communicates with the rod end chambers 23 through the conduit 25. With the dump valve 36 in its first position, the shift end 28 of the quick drop valve 26 is vented to the tank. With the solenoid valve 31 in its first position, the end 38 of the dump valve 36 is also vented to the tank 14 and the portion 25*a* of the conduit 25 is connected to the spring end 27 of the quick drop valve 26. If the blade 12 is being supported by the hydraulic actuators 19, the load generated pressure in the rod end chambers 23 is transmitted to the spring end 27 to aid the force of the spring 29 biasing the quick drop valve 26 to its first position.

To raise the blade 12 the operator moves the control valve 16 leftwardly to direct pressurized fluid from the pump 13 to the rod end chambers 23 and to transmit the fluid expelled from the head end chambers 22 to the tank 14. Some of the pressurized fluid from the pump passes through the pilot passage 34, the solenoid valve 31, the pilot passage 32 to the spring end 27 of the quick drop valve 26 to maintain the quick drop valve 26 in the position shown permitting unrestricted fluid flow therethrough.

To controllably lower the blade 12 from a raised position, the operator moves the control valve 16 rightwardly only part way from the neutral position shown to direct fluid from the pump 13 to the head end chambers 22 and to direct the fluid expelled from the rod end chambers 23 to the tank 14. If the control valve 16 is not moved sufficiently for the cam 47 to engage the switch 43, the solenoid valve 31 remains in its first position so that some of the load generated pressurized fluid expelled from the rod end chambers 23 is directed to the spring end 27 as previously described to maintain the quick drop valve 26 in its first position such that it has no effect on lowering of the blade.

To allow the blade 12 to freefall from the raised position, the operator moves the control valve 16 rightwardly to or beyond a intermediate operating position at which the cam 47 closes the switch 43 to energize the solenoid valve 31 moving it leftwardly to a second position. With the solenoid valve 31 in its leftward position, the spring end 27 of the quick drop valve 26 is vented to the tank 14 and the fluid generated pressure in the pilot passage 34 is directed to the end 38 of the dump valve 36 moving it leftwardly to its second position. At the second position of the dump valve 36 the load generated pressure fluid is transmitted to the shift end 28 of the quick drop valve 26 moving it leftwardly to its second or quick drop position. At the second position of the quick drop valve 26, the fluid expelled from the rod end chambers 23 combines with the fluid passing through the conduit 34 to fill the expanding head end chambers 22. Fluid flow through the portion of the conduit 25 between the quick drop valve 26 and the control valve 16 is blocked at the second position of the quick drop valve 26 so that all of the fluid expelled from the rod end chambers is directed to the head end chambers 22.

When the blade 12 contacts and is subsequently supported by the ground, the pressure of the fluid in the rod end chambers 23 and connecting conduits and passages immediately goes to zero. This allows both the dump valve 36 and the quick drop valve 26 to return to their first positions to again establish communication from the head end chambers 23 to the control valve 16. With the conduit 25 isolated from the conduit 24 by the quick drop valve, full pump pressure can be generated in the head end chambers 22 of the actuators to exert a downward force on the blade 12 even if the control valve 16 is shifted beyond the intermediate position. Moreover, the pump generated pressure in the conduit 24 passes through the pilot passage 41 to the spring end 37 of the dump valve 36 to assist the spring 39 in holding the dump valve 36 in the position shown whereby both ends of the quick drop valve 26 are vented to the tank such that the spring 29 maintains the quick drop valve 26 in the non-quick drop position shown.

In view of the foregoing, it is readily apparent that the structure of the present invention provides an improved quick drop circuit in which all of the fluid expelled from the rod end chamber of the hydraulic actuators when the blade is in a free fall condition is used to help fill the expanding head end chambers when the quick drop valve is in the quick drop position. This is accomplished by using an solenoid valve to trigger the quick drop valve to the quick drop position when the control valve reaches a trigger point rather than moving the quick drop valve to the quick drop position in response to a pressure differential being generated by the expanding fluid passing through an orifice. Thus, the quick drop valve totally blocks the rod end chamber from the control valve during freefall of the blade so that all of the expelled fluid is directed back to the head end chamber. Moreover, the solenoid valve uses load generated pressure to immediately move the quick drop valve to the quick drop position when the solenoid valve is energized upon the control valve reaching the trigger point. Thus, the quick drop valve can be moved to the quick drop position virtually at the beginning of the freefall of the blade such that a lesser amount of the expelled fluid passes through the quick drop valve before it is triggered to the quick drop position.

Other aspects, objects and advantages of this invention can be obtained from a study of the drawings, the disclosure and the appended claims.

We claim:

1. An electro-hydraulic quick drop circuit for a hydraulic system having a hydraulic pump, a tank, a hydraulic actuator having first and second actuating chambers, and a control valve connected to the pump and the tank and having first and second ports connected to the first and second actuating chambers respectively, the control valve being movable from a neutral position through an intermediate operating position to a fully open position, the circuit comprising:

a quick drop valve disposed between the control valve and the first and second chambers and having a first position communicating the first and second ports with the first and second actuating chambers and a second position communicating both the first port and the second actuating chamber with the first actuating chamber and blocking the second actuating chamber from the second port, the quick drop valve having first and second ends and a spring resiliently biasing the quick drop valve to the first position;

two-position solenoid valve connected to the second actuating chamber and to the ends of the quick drop valve and having a first position communicating fluid from the second actuating chamber to the first end of the quick drop valve aiding the force of the spring and a second position communicating fluid from the actuating chamber to the second end of the quick drop valve opposing the force of the spring; and means for energizing the solenoid valve and moving it to the second position when the control valve is positioned between the intermediate operating position and the fully open position.

2. The electro-hydraulic quick drop circuit of claim 1 wherein the energizing means includes a source of electrical energy, an electrical switch connected to the source and the solenoid valve and positioned at a location to be closed when the control valve is at or between the intermediate operating position and the fully open position.

3. The electro-hydraulic quick drop circuit of claim 2 including a pilot passage disposed between the solenoid valve and the second end of the quick drop valve and a dump valve disposed within the pilot passage and connected to the tank, the dump valve being movable between a first position at which the pilot passage 33 is vented to the tank and a second position at which communication through the pilot passage is established.

4. The electro-hydraulic quick drop circuit of claim 3 wherein the dump valve has a spring resiliently biasing it to the first position, and a first end fluidly connected to the first actuating chamber.

5. The electro-hydraulic quick drop circuit of claim 4 wherein the dump valve has another end fluidly connected to the second actuating chamber when the solenoid valve is at its second position.

* * * * *